US005951826A

United States Patent [19]

Yoshimura

[11] Patent Number: 5,951,826

[45] Date of Patent: Sep. 14, 1999

[54] RECYCLING APPARATUS FOR OBTAINING OIL FROM PLASTIC WASTE

[75] Inventor: Takeki Yoshimura, Nagano, Japan

[73] Assignees: MCC Co., Ltd.; Miwagumi Co., Ltd., both of Nagano, Japan

[21] Appl. No.: 09/114,104

[22] Filed: Jul. 10, 1998

[51] Int. Cl.[6] ..... C10B 1/04

[52] U.S. Cl. ..... 202/105; 202/118; 202/120; 202/209; 585/241

[58] Field of Search ..... 202/105, 84, 120, 202/209; 985/241

[56] References Cited

U.S. PATENT DOCUMENTS 5,738,025 4/1998 Tachibana ..... 110/346

*Primary Examiner*—Bekir L. Yildirim

*Attorney, Agent, or Firm*—Burgess, Ryan & Wayne

[57] ABSTRACT

A recycling apparatus for obtaining oil from waste plastic by thermal decomposition has a thermal decomposition tank 2 comprising a tank proper 3. The inside of the tank proper 3 is divided by a partition 7 into a thermal decomposition chamber at its front and a melting chamber at its rear, with a communicating space to connect the thermal decomposition and melting chambers and provided below the partition. Heating pipes are disposed in the tank proper so that hot air travels from the thermal decomposition chamber through the communicating spaces to the melting chamber. This arrangement permits keeping the thermal decomposition chamber, communicating spaces and melting chamber at temperatures suited for thermal decomposition and melting, thereby realizing design simplification and size reduction, permitting substantial cost savings and ease of maintenance, and increasing productivity and economy.

12 Claims, 6 Drawing Sheets

RECYCLING APPARATUS FOR OBTAINING OIL FROM PLASTIC WASTE

BACKGROUND OF THE INVENTION

This invention relates to recycling apparatus for obtaining oil from waste plastics.

Conventional apparatus to obtain heavy oil (fuel oil or its equivalent) from waste plastics (high-polymeric waste) involves thermal decomposition.

This type of conventional apparatus melts solid waste plastics such as polyethylene, polyester and vinyl chloride at the relatively low temperature of approximately 250° C. (or 70° C. for vinyl chloride) in a melting tank, resulting in thermal decomposition of the molten waste plastics in a thermal decomposition tank heated to approximately 400° C. (or 170° C. for vinyl chloride). The desired heavy oil is obtained by cooling the gas produced by the thermal decomposition.

If solid waste plastics are directly charged to the thermal decomposition tank, the waste plastics will become carbonized. This carbonization lowers recycling efficiency, and the product of carbonization is not easy to dispose of. This is the reason why a melting tank is required to first melt the solid waste plastic.

However, conventional apparatuses of the type just mentioned have involved a number of problems.

First, the need for the melting tank in addition to the thermal decomposition tank makes the whole assembly more intricate, larger, more costly and difficult to maintain.

Second, the longer time required for the processing of waste plastics lowers the productivity and increases the production cost of heavy oil.

This invention solves the aforementioned problems with the conventional technologies. The object of this invention is to provide simple and compact recycling apparatus for obtaining oil from waste plastics resulting in substantial cost savings and ease of maintenance while offering higher productivity and greater economy.

SUMMARY OF THE INVENTION

To achieve the above objects, a recycling apparatus 1 for obtaining oil from waste plastic P by thermal decomposition in a thermal decomposition tank 2 according to this invention comprises a tank proper 3 that is divided by a partition 7 into a thermal decomposition chamber Rf at the front and a melting chamber Rr at the rear that are connected to each other by a communicating space Rc below the partition 7 and heating pipes 41, 4*b*, 4*c*, 4*d*, 4*e* and 4*f* communicating with a hot-air generator, the thermal decomposition chamber, the communicating space, the melting chamber and a flue duct leading to the outside atmosphere.

DETAILED DESCRIPTION OF THE INVENTION

Figure 1:
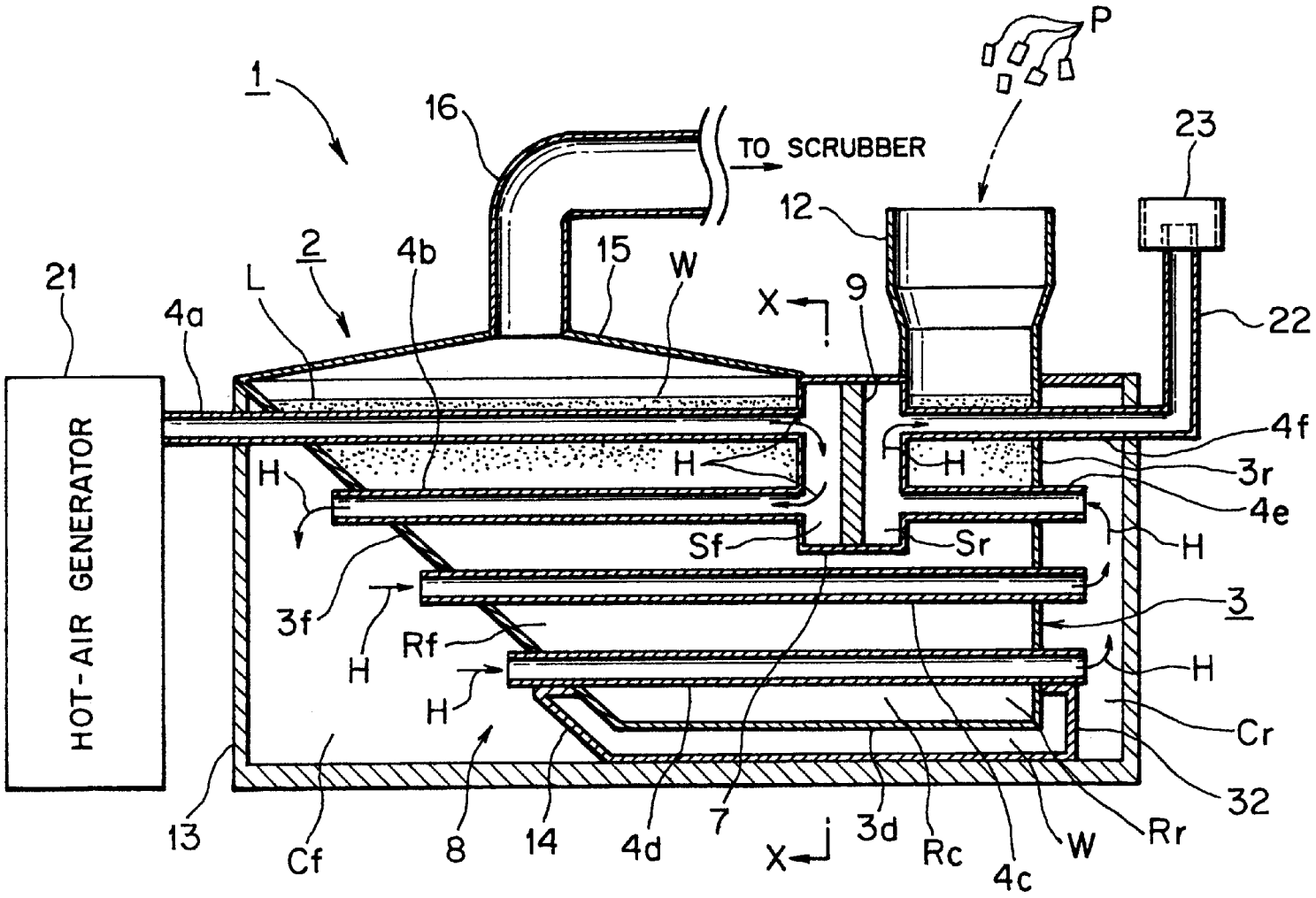
FIG. 1 is a cross-sectional side elevation of a thermal decomposition tank comprising the principal part of structure (1) and the first embodiment of the plastic recycling apparatus according to this invention.
Figure 6:
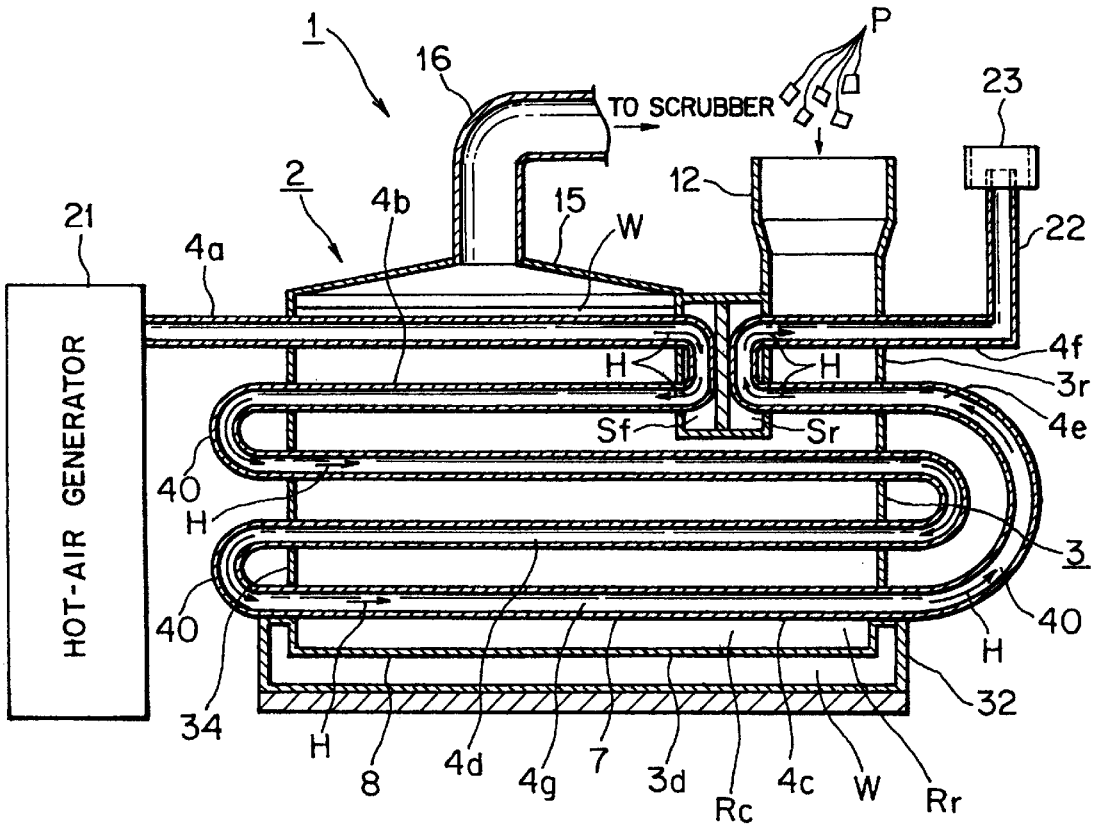
FIG. 6 is a cross-sectional side elevation of a thermal decomposition tank that comprises the principal part of structure (2) and the second embodiment of the plastic recycling apparatus according to this invention.

FIGS. 1 and 6 show embodiments for solving the problems with conventional apparatus described earlier.

The embodiment shown in FIG. 1 comprises an enclosed tank proper 3 having front and rear air passages 8, multiple heating pipes 4*a*, 4*b*, 4*c*, 4*d*, 4*e* and 4*f* disposed between a front communicating space Cf and a partition 7 (4*a* and 4B), between a rear communicating space Cr and the partition 7 (4*e* and 4*f*), and between the front and rear communicating spaces Cf and Cr (4*c* and 4*d*), a hot-air generator 21 to which the heating pipes between the front communicating space Cf and the partition 7 are connected, and a flue duct leading to the outside atmosphere to which the heating pipes (4*e* and 4F) between the rear communicating space Cr and the partition 7 are connected.

On the other hand, the embodiment shown in FIG. 6 has multiple heating pipes 4*a*, 4*b*, 4*c*, 4*e* and 4*f* that are bent and connected to the hot-air generator, melting chamber and flue duct in the order mentioned.

The arrangement shown in FIGS. 1 and 6 permits keeping the heating pipes in the thermal decomposition chamber at a temperature suited for thermal decomposition, those in the melting chamber at a temperature suited for melting, and those in the communicating spaces at a temperature therebetween.

Solid waste plastic P charged into the melting chamber Rr is heated and melted by the heating pipes 4*f*, 4*e*, 4*c* and 4*d* that are kept at a relatively low temperature. The molten waste plastic L reaches the thermal decomposition chamber Rf through the communicating space Rc. As the quantity of the molten waste plastic L increases, the top level thereof rises to the higher part of the thermal decomposition chamber Rf. The molten waste plastic L thus reaching the heating pipe 4*a*, kept at a higher temperature in the higher part of the thermal decomposition chamber Rf, is heated and gasified by thermal decomposition. The gasified cracked gas is cooled and liquified into heavy oil (fuel oil A equivalent).

The thermal decomposition tank also acting as the melting tank is conducive to the overall simplification and size reduction of the apparatus and the achievement of substantial cost savings and ease of maintenance while offering higher productivity and greater economy in the production of heavy oil.

In FIG. 1, the tank proper 3 has a tapered front end 3*f* and is constricted toward the bottom. The constricted bottom permits reducing the heat required for keeping the waste plastic L matter when the apparatus is out of operation. When the apparatus is in operation, the molten waste plastic L rises as its specific gravity becomes lower as the transition from a molten state to a thermally decomposed state proceeds after the molten waste plastic L has moved through the communicating space Rc to the thermal decomposition chamber Rf. Therefore, the constricted bottom allows for the expansion of the rising molten waste plastic.

The tank in the embodiment shown in FIG. 6 has an upright front 3*f*, without being constricted toward the bottom. However, it is of course possible to design a tank like that shown in FIG. 1.

Nevertheless, the designs described above are not the essential elements of this invention.

EMBODIMENTS

Figure 2:
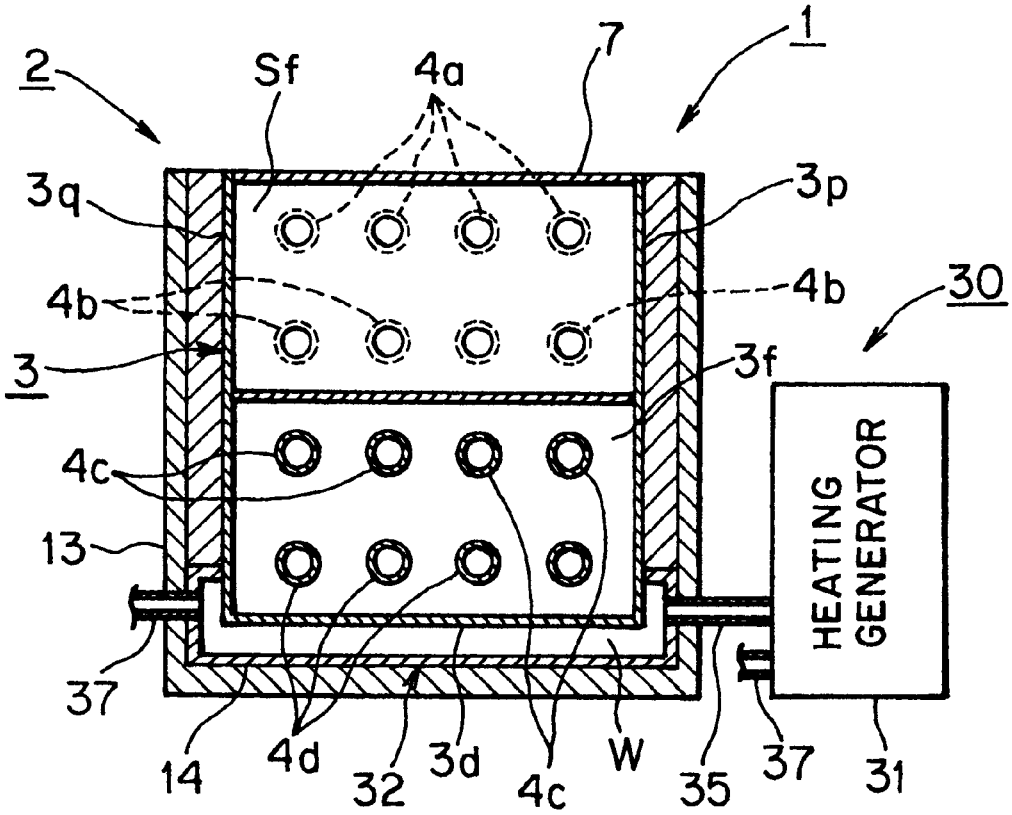
FIG. 2 is a cross-sectional front view taken along the line X—X of FIG. 1.

The embodiment shown in FIG. 1 will be described by reference to FIGS. 2 and 5.

In the drawings, reference numeral 2 designates a thermal decomposition tank that constitutes the principal part of the oil recycling apparatus 1. The thermal decomposition tank 2 comprises a tank proper 3 that, in turn, consists of a front end 3*f*, a rear end 3*r* and a bottom 3*d*, as shown in FIGS. 1 and 2.

A partition 7 is provided between the left side 3*p* and right side 3*q* in the middle of the tank 3. The partition 7 is a closed hollow structure. The inside of the partition 7 is divided by a partition wall 9 into a front space Sf and a rear space Sr. Thus, a thermal decomposition chamber Rf and a melting chamber Rr are formed before and behind the partition 7, while a communicating space Rc is formed below the partition 7.

The outer bottom of the tank proper 3 is covered with an outer plate 24, thus providing a closed heat-retaining space between the outer plate 14 and the tank proper 3. Heat-retaining oil W is supplied to the heat-retaining space 32 from a heating device 31 described below. In the first embodiment shown in FIG. 1, an outer housing 13 covers the tank proper 3 with the outer plate 14, the front communicating space Cf and the rear communicating space Cr. The front communicating space Cf is between the tapered front end 3*f* of the tank proper 3 and the outer housing 13, whereas the rear communicating space Cr is between the rear end 3*r* of the tank proper 3 and the outer housing 13.

Four horizontally spaced heating pipes 4*a* are provided in the uppermost part of the thermal decomposition chamber Rf, with the front openings thereof leading to the outside of the outer housing 13 and the rear (inner) openings connected to the front space Sf in the partition 7. A lower group of four horizontally spaced heating pipes 4*b* are similarly disposed in the thermal decomposition chamber Rf, with the front openings thereof leading to the front communicating space Cf and the rear (inner)openings connected to the front space Sf. Additional lower groups of four each horizontally spaced heating pipes 4*c* and 4*d* are also provided in the thermal decomposition chamber Rf. The heating pipes 4*c* and 4*d* pass through the thermal decomposition chamber Rf, communicating space Rc and melting chamber Rr. The openings at both ends of the heating pipes 4*c* and 4*d* lead to the front and rear communicating spaces Cf and Cr, as shown in FIG. 1.

Horizontally spaced four heating pipes 4*f* are provided in the uppermost part of the melting chamber Rr, with the front (inner) openings of the heating pipes 4*f* connected to the rear space Sr in the partition 7 and the rear openings thereof leading to the outside of the outer housing 13. A lower group of four horizontally spaced heating pipes 4*e* are similarly disposed in the melting chamber Rf, with the front (inner) openings of the heating pipes connected to the rear space Sr in the partition 7 and the rear openings thereof leading to the rear communicating space Cr. The heating pipes 4*a*, 4*b*, 4*c*, 4*d*, 4*e* and 4*f* are individually spaced at intervals of 10 to 15 cm.

This arrangement forms a continuous air passage 8 leading from the heating pipes 4*a* through the front space Sf, heating pipes 4*b*, front communicating space Cf, heating pipes 4*c* and 4*d*, rear communicating space Cr, heating pipes 4*e* and rear space Sr to the heating pipes 4*f*.

In FIG. 1, the uppermost heating pipes 4*a* and 4*f* in the thermal decomposition and melting chambers are connected to the hot-air generator 21 and flue duct 22, respectively. However, the pipe connection of the pattern just described is not an absolutely necessary requirement of this invention. Any other pattern of pipe connection suffices so long as the proper temperature is attained in the thermal decomposition chamber, melting chamber and communicating spaces.

A hopper 12 through which solid waste plastic P is charged inside is mounted at the upper end of the melting chamber Rr. Reference numeral 15 designates a cover to cover the top of the tank proper 3, with a duct 16 to collect the cracked gas connected to the highest point at the center there of. The duct 16 is connected to a scrubber 52 described later.

The outer openings of the uppermost heating pipes 4*a* are connected to the hot-air generator 21, whereas the outer openings of the heating pipes 4*f* are connected to the flue duct 22 having a blower 23. Thus, hot air H supplied from the hot-air generator 21 is discharged to the outside through the flue duct 22. The temperature of the heating pipes 4*a* in the upper part of the thermal decomposition chamber Rf is higher than that of the heating pipes 4*d*, 4*c*, 4*e* and 4*f* in the melting chamber Rr. The heating pipes 4*f* located downstream have a lower temperature than the heating pipes 4*a* located upstream because the hot air H loses its heat as it travels through the air passage 8.

Accordingly, the diameter, length, number, space intervals and other conditions of the individual heating pipes 4*a*, 4*b*, 4*c*, 4*d*, 4*e* and 4*f* are determined so that the temperature of the lower heating pipes 4*c* and 4*d* becomes high enough (usually 250° C., or 70° C. for vinyl chloride) to melt the waste plastic P when the temperature of the uppermost heating pipes 4*a* reaches a temperature high enough (usually 400° C., or 170° C. for vinyl chloride) to thermally decompose the molten waste plastic L.

The thermal decomposition chamber requires not only high temperature but also a large number of calories. Therefore, the heating pipes 4*a* and 4*b* in the thermal decomposition chamber may be designed to have a larger diameter than the heating pipes 4*c*, 4*d*, 4*e* and 4*f*. Also, the heating pipes 4*a* and 4*b* in the thermal decomposition chamber may be zigzagged to increase the contact area with the surroundings.

Figure 3:
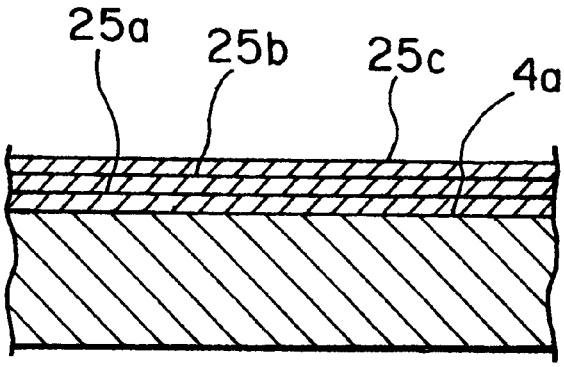
FIG. 3 is a cross-sectional view showing a part of a heating pipe in the thermal decomposition tank.

A heat-resisting liquid glass (that becomes solid at room temperature) is coated on the outer surface of the heating pipes 4*a* and the inner surface of the tank proper 3 that come in contact with the molten waste plastic L and the cracked gas. Being made of steel or other metals, the heating pipes 4*a* and tank proper 3 are vulnerable to corrosive attack due to oxidation associated with heating. Particularly, when the waste plastic is vinyl chloride, the hydrogen chloride generated by thermal decomposition rapidly corrodes and oxidizes metals. Therefore, the liquid glass 25*a* is coated on the surface of the heating pipes 4*a* and other surfaces to impart adequate chemical resistance, corrosion resistance and durability. It is preferable to provide multilayered coatings by applying several layers of liquid glass 25*a*, 25*b* and 25*c* on the surface of the heating pipes 41, as shown in FIG. 3.

Figure 5:
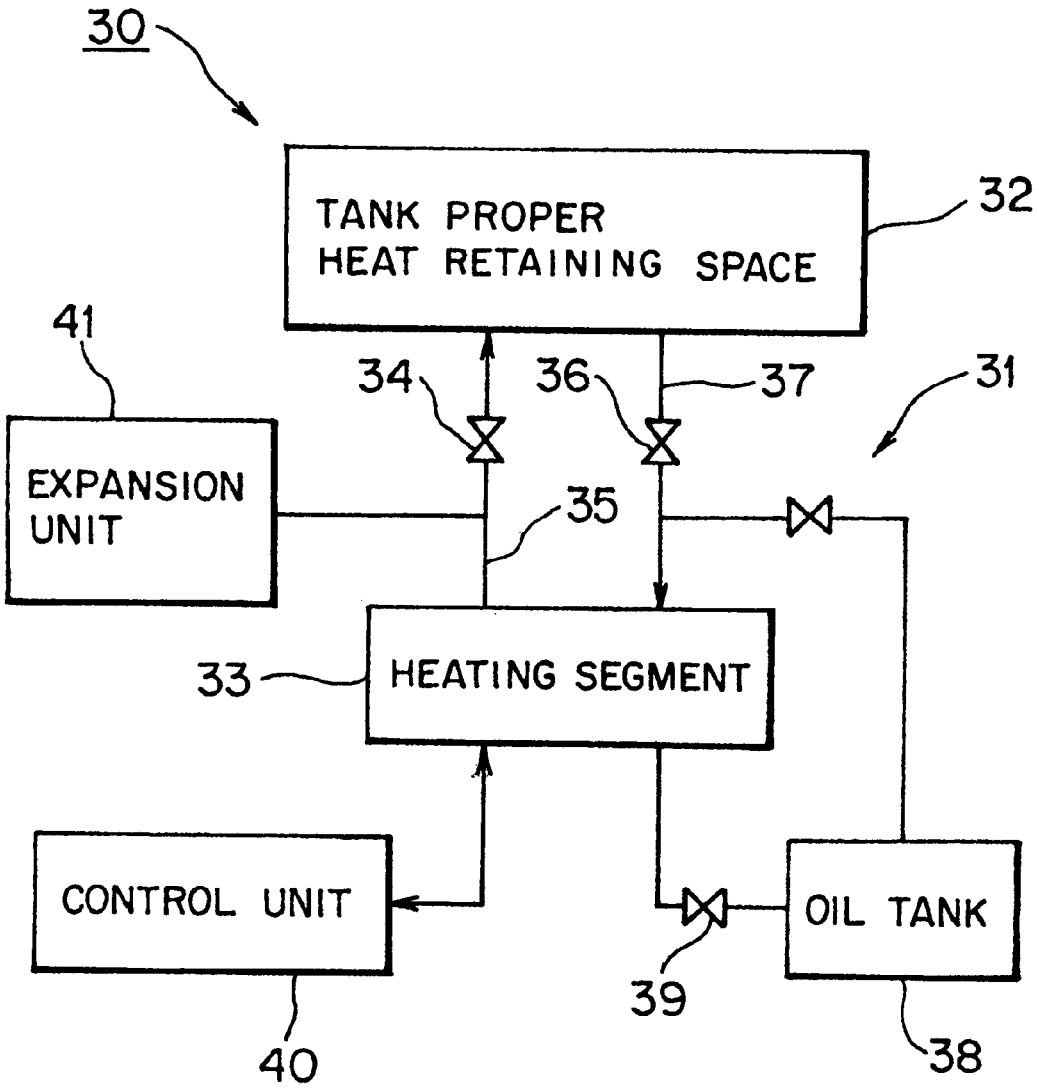
FIG. 5 is a block diagram of a heat-retaining device provided to the plastic recycling apparatus.

Furthermore, a heat-retaining device 30 shown in FIG. 5 is attached to the thermal decomposition tank 2. The heat-retaining device 30 has a heating device 31 which, in turn, has a heating segment 33. The heating segment 33 has a discharge port that is connected to one side of the upper part of the heat-retaining space 32 mentioned earlier via piping 35 having a valve 34 as shown in FIGS. 2 and 5 and a suction port that is connected to the other side of the upper part of the heat-retaining space 32 via piping 37 having a valve 36. Thus, the heat-retaining oil c heated in the heating segment 33 is supplied through the piping 35 to the space S that constitutes the heat-retaining space 32 between the outer plate 14 and the tank proper 3 and then through the piping 37 back to the heating segment 33, thus forming a heating circulation circuit. Reference numeral 38 designates an oil tank connected to the heating segment 33 via a valve 39, 40 a control unit that controls the operation and heating temperature of the heating segment 33, and 41 is an expansion unit that includes a function to liquefy the gasified heat-retaining oil.

Figure 4:
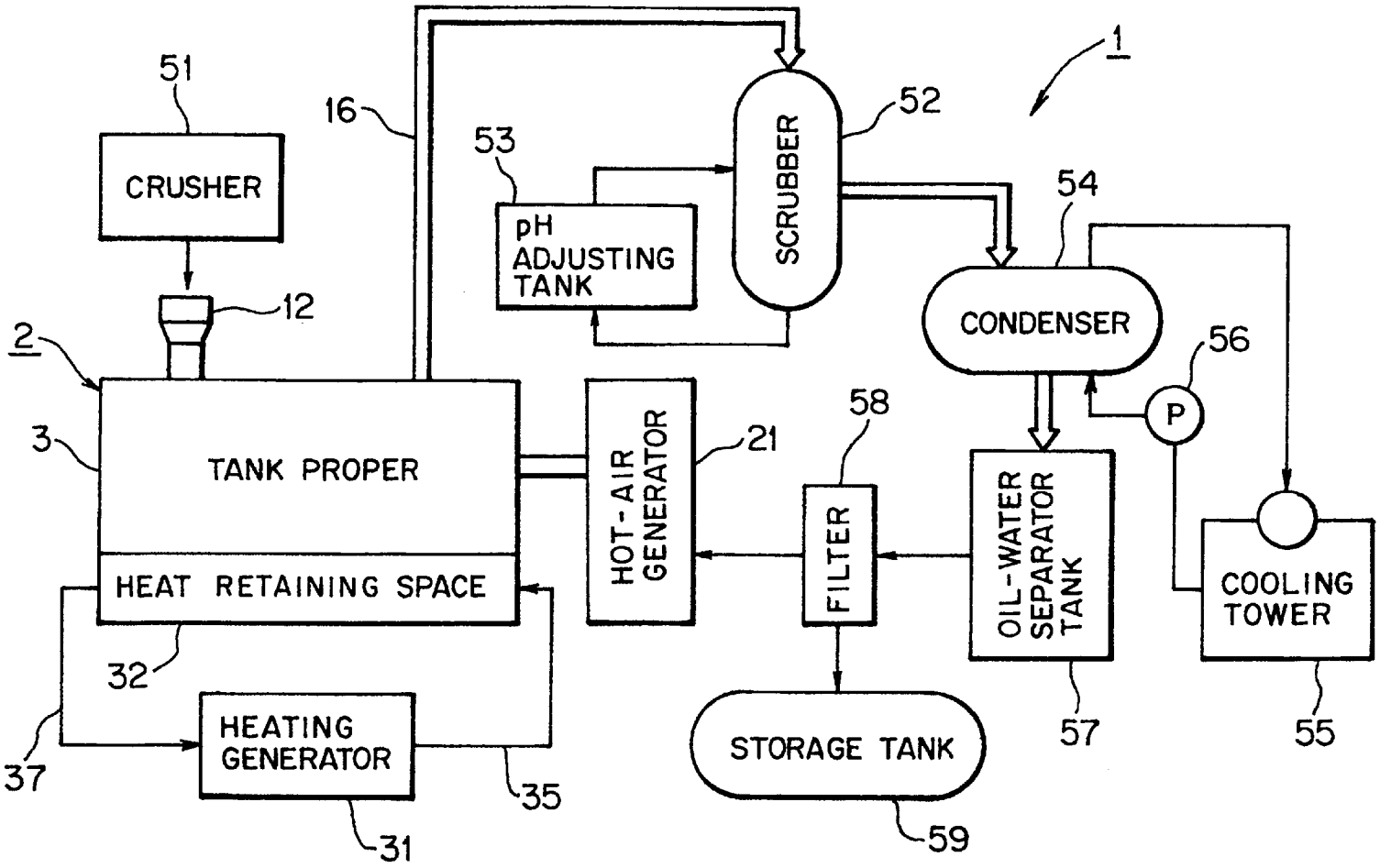
FIG. 4 is a block diagram showing the entire plastic recycling apparatus.

FIG. 4 shows the entire configuration of a plastic recycling apparatus 1 having the thermal decomposition tank 2. In FIG. 4, reference numeral 51 designates a crusher that breaks large waste plastic into small pieces, 52 a scrubber that neutralizes hydrogen chloride gas, 53 a pH adjusting tank attached to the scrubber, 54 a condenser to liquefy the cracked gas, 55 a cooler (cooling tower) to provide cooling water, to cool the condenser 54, 56 a pump, 57 an oil-water separator tank to separate the obtained heavy oil from water, 58 a filter, and 59 a heavy oil storage tank.

The overall operations of the oil recycling apparatus 1 including the thermal decomposition tank 2 are described below by reference to the relevant drawings.

First, the hot-air generator 21 supplies hot air H to the uppermost heating pipes 4*a*, as indicated by the arrow in FIG. 1, that are thereby heated to approximately 400° C. (or 170° C. for vinyl chloride). The lower heating pipes 4*c* and 4*d* are heated to approximately 250° C. (or 70° C. for vinyl chloride). The hot air H having passed through the air passage 8 is then discharged outside via the flue duct 22, with the help of the suction provided by the blower 23.

The solid waste plastic P (such as polyethylene, polyester and vinyl chloride) is charged into the hopper 12. The crusher 51 breaks large pieces into smaller ones. The solid waster plastic P charged into the hopper 12 is then supplied to the inside of the melting chamber Rr.

In the tank proper 3, the waste plastic P falls to the bottom thereof where it is heated and melted by the heating pipes 4*c* and 4*d* kept at a relatively low temperature. The molten waste plastic L enters the thermal decomposition chamber Rf through the communicating space Rc and is stored in the tank proper 3 and the top surface thereof rises as the quantity stored increases. When the rising top surface reaches the heating pipes 4*a* kept at a high temperature in the upper part of the thermal decomposition chamber Rf, the molten waste plastic L heated by the heating pipes 4*a* is thermally decomposed and gasified.

The cracked gas thus produced passes through the duct 16 to the scrubber 52 where the hydrogen chloride gas contained in the cracked gas is neutralized. The cracked gas is then supplied from the scrubber 52 to the condenser 54 where it is cooled and liquefied into heavy oil (fuel oil A equivalent). The condenser 54 is always cooled by a cooling liquid supplied from the cooling means 55. The obtained heavy oil is supplied to the oil-water separator tank 57 that separates water from the heavy oil. The filter 58 removes impurities from the heavy oil. The heavy oil thus obtained is stored in the storage tank 59. Part of the heavy oil is supplied to the hot-air generator 21 as a fuel.

When the oil apparatus 1 is out of operation as during the night, the heat-retaining device 30 keeps the tank proper 3 hot to maintain the plastic in a molten state. The heating segment 33 heats the heat-retaining oil W to a temperature between 70 and 400° C. The heat-retaining oil W thus is supplied through the piping 35 to the space between the outer plate 14 and the tank proper 3 that make up the heat-retaining space 32. The heat-retaining oil W is then returned from the space to the heating segment 33 through the piping 37. This keep the molten waste plastic L remaining in the tank proper 3 warm and molten, thereby significantly reducing the start-up time.

The description made by reference to FIGS. 2 to 5 generally applies to the embodiment shown in FIG. 6.

In the second embodiment, however, the heating pipes 4*a*, 4*b*, 4*d*, 4*e* and 4*f* are zigzagged and connected to one another to form a continuous conduit as shown in FIG. 6.

As can be seen in FIG. 6, the heating pipes 4*a* and 4*b* are bent or connected on the outside of the front and rear ends 3*f* and 3*r* and in the front and rear spaces Sf and Sr in the partition 7. The bent or connected segments of the heating pipes thus formed are in contact with the outside atmosphere, as a result of which the hot air passing through loses its heat gradually.

However, the temperature of the heating pipes can be gradually lowered without holding them in contact with the outside atmosphere, depending on the quantity and velocity of the hot air in the heating pipes. Therefore, protruding the heating pipes in front of and behind the tank proper 3 is not an essential requirement of this invention.

In addition to the embodiment shown in FIG. 6, a modification of the embodiment shown in FIG. 1 is also possible. In this modified design, the heating pipes 4*a* and 4*b* communicate with the heating pipes 4*e* and 4*f* through the front and rear spaces Sf and Sr in the partition 7.

Figure 7:
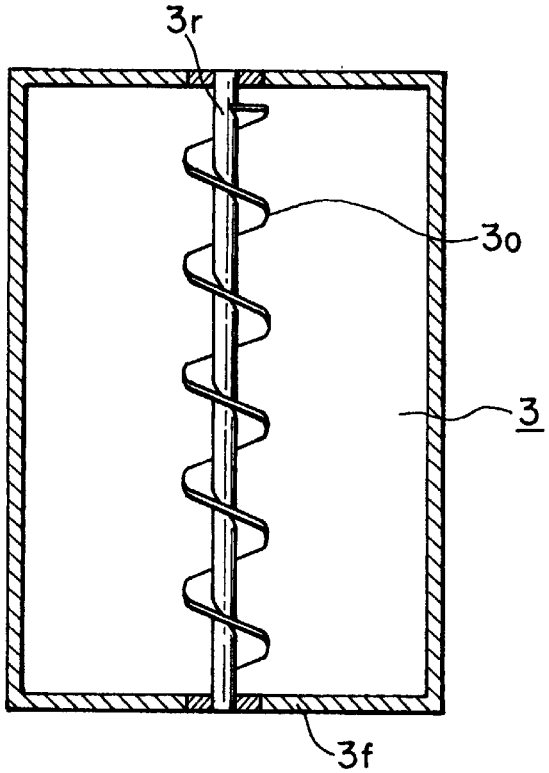
FIG. 7 is a cross-sectional top view of a screw conveyor in the tank proper of the first design of the third embodiment.

FIG. 7 shows the first design of the third embodiment which comprises a screw conveyor 30 to carry forward the molten waste plastic or solid waste plastic being melted charged between the front and rear ends 3*f* and 3*r* below the partition 7 (at the level of the melting chamber Rr and thermal decomposition chamber Rf, or at the level of the communication space Rc) in the tank proper 3.

The screw conveyor quickly transports the waste plastic from the rear to the front. Stirring performed by the screw conveyor 30 in the tank proper 3 permits efficient conduction of heat from the heating pipes, thereby increasing the efficiency of melting and thermal decomposition.

Figure 8:
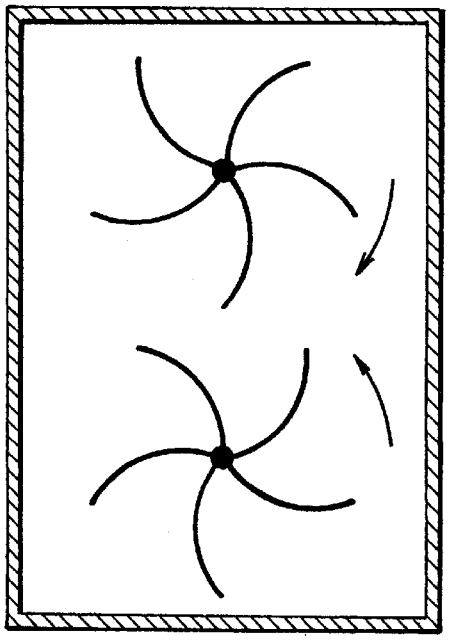
FIG. 8 is a cross-sectional top view of the rotor blades in the tank proper of the second design of the third embodiment.

FIG. 8 shows the second design of the third embodiment that has one or more horizontally rotating rotor blades 60, in place of the screw conveyor provided in the first design.

The rotary blades 60 which are concave in the direction of rotation carry forward the molten waste plastic or the waste plastic being melted and stir the inside of the tank proper 3, thereby producing the same effect as the first design of the third embodiment in increasing the efficiency of operation.

This invention can be embodied in various ways other than those stated in the embodiments described above, in respect of detailed design, shape, material, quantity and method, without departing from its spirit and scope.

The plastics recycling apparatus according to this invention has a tank proper whose front end is tapered to form a cross section constricted toward the bottom. The partition provided in the tank proper divides it into the thermal decomposition chamber at the front and the melting chamber at the rear, with the communicating space provided there below. Multiple heating pipes are spaced at given intervals both vertically and horizontally in the tank proper, with the air passages connected to the front and rear ends thereof. The heating pipes in the upper part of the thermal decomposition chamber have a higher temperature than the heating pipes in the melting chamber.

Thus, the oil recycling apparatus according to this invention have the following beneficial effects:

(1) the combination thermal decomposition and melting tank is conducive to the overall simplification and size reduction of the apparatus and the achievement of substantial cost savings and ease of maintenance.

(2) processing of waste plastics at an increased speed greatly increases the productivity and economy in heavy oil production.

What is claimed is:

1. A recycling apparatus for obtaining oil from waste plastic by thermal decomposition comprising: a tank proper that is divided by a partition into a thermal decomposition chamber at the front and a melting chamber at the rear, with a space through which the thermal decomposition and melting chambers communicate with each other provided below the partition, and heating pipes leading from a hot-air generator through the thermal decomposition chamber, the communicating space and the melting chamber to a flue duct leading to the outside atmosphere.

2. The recycling apparatus for obtaining oil from waste plastic according to claim 1, in which multiple heating pipes having air passages at the front and rear are disposed above one another and between the front communicating space shut off from the outside and the partition in the tank proper, between the rear communicating space shut off from the outside and the partition in the tank proper, and between front and rear communicating spaces shut off from the outside and disposed below the partition in the tank proper, with the heating pipes between the front communicating space and the partition in the tank proper connected to the hot-air generator and the heating pipes between the rear communicating space and the partition in the tank proper connected to the flue duct on the outside.

3. The recycling apparatus for obtaining oil from waste plastic according to claim 1, in which one or more heating pipes are zigzagged and connected from the hot-air generator through the thermal decomposition chamber thereby communicating with the outside atmosphere.

4. The recycling apparatus for obtaining oil from waste plastic according to claim 1, in which the tank proper is constricted downward from above.

5. The recycling apparatus for obtaining oil from waste plastic according to claim 1, in which a screw conveyor to transport waste plastic from rear to front is provided below the partition in the tank proper.

6. The recycling apparatus for obtaining oil from waste plastic according to claim 1, in which at least one horizontal rotatable blade is provided below the partition in the tank proper.

7. The recycling apparatus for obtaining oil from waste plastic according to claim 1, in which the upper part of the thermal decomposition chamber is connected to a scrubber to neutralize hydrogen chloride, the scrubber being connected to a condenser interlocked with a cooler and connected to an oil-water separator tank.

8. The recycling apparatus for obtaining oil from waste plastic according to claim 1, in which the oil-water separator tank is in communication with a storage tank and the hot-air generator through a filter.

9. The recycling apparatus for obtaining oil from waste plastic according to claim 1, in which metal surfaces in contact with the cracked gas resulting from thermal decomposition are coated with a heat-resisting glass which is liquid at elevated temperatures and solid at room temperatures.

10. The recycling apparatus for obtaining oil from waste plastic according to claim 8, in which the coating is accomplished by applying glass in layers.

11. The recycling apparatus for obtaining oil from waste plastic according to claim 1, in which the heating pipes in the thermal decomposition chamber have a larger diameter than the heating pipes in the melting chamber.

12. The recycling apparatus for obtaining oil from waste plastic according to claim 1, in which the heating pipes in the thermal decomposition chamber are zigzagged.

* * * * *